US005123208A

United States Patent [19]

Kirby et al.

[11] Patent Number: 5,123,208

[45] Date of Patent: Jun. 23, 1992

[54] REGLET ASSEMBLY WITH SNAP-ON FLASHING

[75] Inventors: Ralph Kirby; Donald W. Schultz; John B. Hickman; Mark D. Braine, all of Asheville; Richard G. Tuttle, Hendersonville, all of N.C.

[73] Assignee: W. P. Hickman Company, Asheville, N.C.

[21] Appl. No.: 612,663

[22] Filed: Nov. 13, 1990

[51] Int. Cl.[5] ..... E04F 19/02

[52] U.S. Cl. ..... 52/58; 52/60; 52/96; 52/61

[58] Field of Search ..... 52/58, 96, 273, 60, 52/61

[56] References Cited

U.S. PATENT DOCUMENTS

| | | | |
|---|---|---|---|
| 1,237,840 | 4/1920 | Hawley . | |
| 1,740,753 | 12/1929 | Vallas . | |
| 1,782,246 | 11/1930 | Schneider . | |
| 2,160,758 | 5/1939 | Schurman . | |
| 2,219,992 | 10/1940 | Hanson . | |
| 2,250,548 | 7/1941 | Ness . | |
| 2,755,484 | 7/1956 | Hotz . | |
| 3,277,618 | 10/1966 | Smith | 52/58 |
| 3,318,061 | 5/1967 | Stentz . | |
| 3,359,692 | 12/1967 | Dzwonkas | 52/60 |
| 3,404,495 | 10/1968 | Simpson | 52/58 |
| 3,432,976 | 3/1969 | Berg . | |
| 3,608,255 | 9/1971 | Chomes . | |
| 3,696,575 | 10/1972 | Armstrong . | |
| 3,731,439 | 5/1973 | Hickman . | |
| 3,735,540 | 5/1973 | Thaler | 52/96 |
| 3,958,374 | 5/1976 | Gobel | 52/60 |
| 4,231,141 | 11/1980 | Derrick et al. . | |
| 4,586,301 | 5/1986 | Hickman . | |
| 4,780,997 | 11/1988 | Taylor et al. | 52/96 |
| 4,970,832 | 11/1990 | van Herpen | 52/96 |

FOREIGN PATENT DOCUMENTS

| | | |
|---|---|---|
| 1347974 | 2/1974 | United Kingdom . |
| 2162877A | 2/1986 | United Kingdom . |

OTHER PUBLICATIONS

Hickman Formed Products; Hickman Accessories; Hickman Reglets-1 page.

Pp/product presentation-Hickman-Reglets Control Water Where a Roof Meets A Wall; Surface-Mounted Reglet; Hinge-Lock 2-Piece Reglet & Flashing System; Snap-On Reglet and Flashing-1 page.

Hickman Safeguard Gravel Stop typical installation (with extenders) 1 page.

*Primary Examiner*—David A. Scherbel
*Assistant Examiner*—Wynn E. Wood
*Attorney, Agent, or Firm*—Harness, Dickey & Pierce

[57] ABSTRACT

A reglet or flashing assembly includes a termination bar member with a snap-on resilient flashing and accommodates longitudinal expansion without leakage at longitudinally-adjacent joints, as well as providing for such a snap-on flashing or skirt component that only requires installation forces that are directed toward the wall, thus avoiding adverse effects on sealants, water-proof membranes, or other wall surface panels or structures. In at least one version, the reglet assembly also accommodates irregularities along the surface of the wall, such as high or low points or recesses resulting from masonry mortar joints.

30 Claims, 2 Drawing Sheets

FIG. 3.
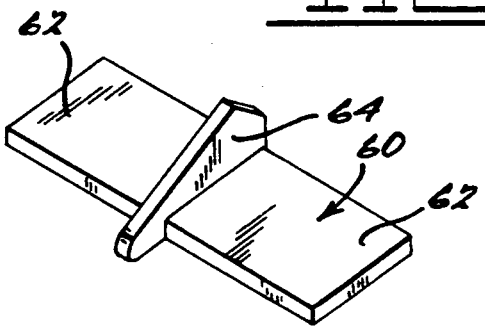
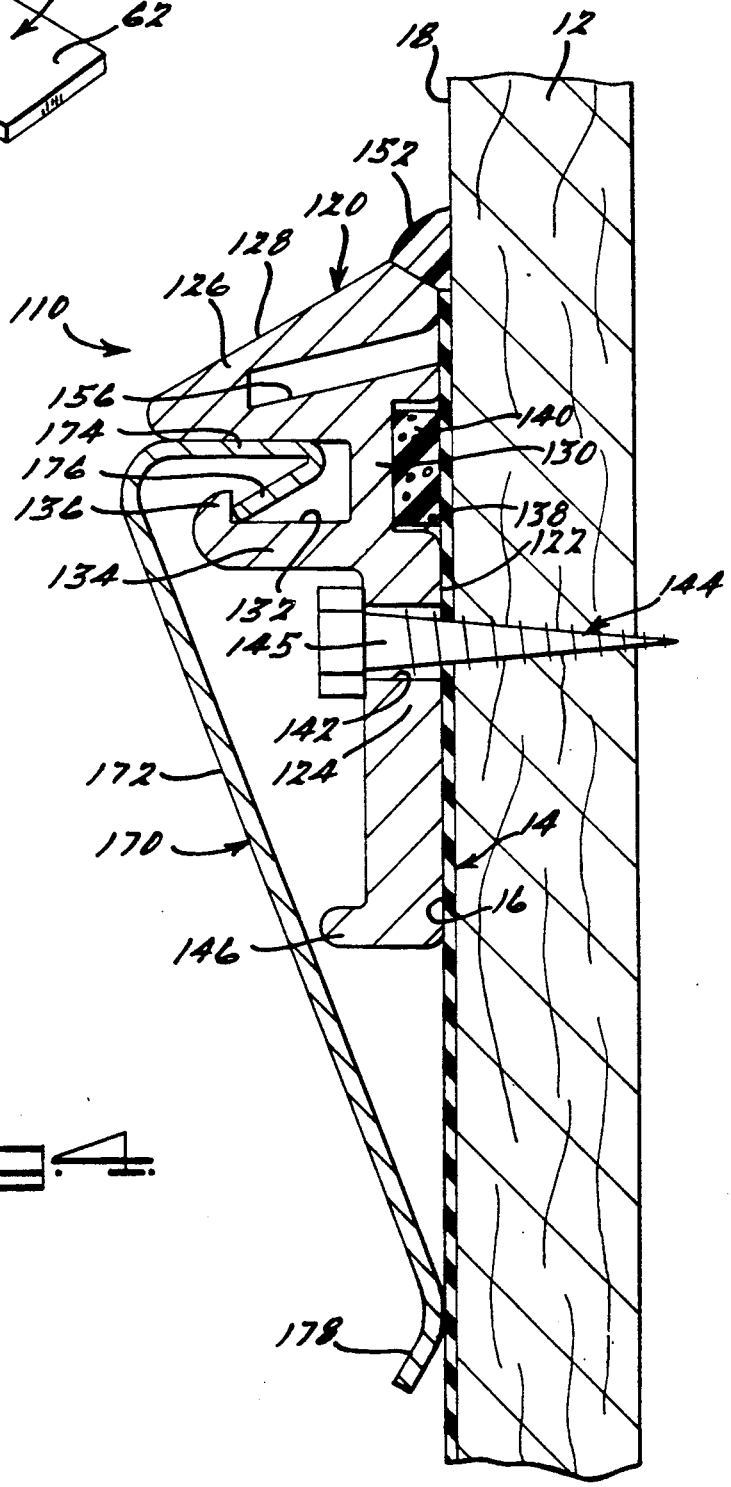
FIG. 4.

REGLET ASSEMBLY WITH SNAP-ON FLASHING

BACKGROUND AND SUMMARY OF THE INVENTION

The invention relates generally to reglet, flashing, or coping structures, and more specifically to such structures having a snap-on flashing member, with the structure being advantageously used to form a water-tight cover or flashing on the surface of a wall where two or more wall surfaces or wall materials meet. Such applications include situations where two or more adjacent wall panels meet, as well as situations where a wall panel, water-proof membrane, or other relatively thin structure terminates along the surface of a wall structure.

Various prior art reglet, coping, or flashing devices have been used to form a water-tight cover for joints or termination areas of different wall materials in the prior art. Although most of the prior art devices have performed relatively well, many have been found to be difficult to assemble and install, and have been unsatisfactory in installations covering the termination of a water-proof membrane extending along a portion of the wall. In addition, longitudinally-adjacent sections of such prior art devices have frequently been difficult to properly align, thus presenting the possibility of leaks at adjoining section joints and making a neat installation difficult and expensive to achieve. In addition, the installation forces exerted by the components of some prior art reglet or flashing structures have been found to result in a rotation or pulling action that tends to pull sealants away from the wall or otherwise adversely affect the water-proof performance of wall membranes or thin panels. Finally, many prior art reglet, coping, or flashing assemblies have not properly allowed for longitudinal expansion of longitudinally adjacent sections of the assembly, thus further presenting the possibility of leakage at longitudinally-adjacent joints.

The present invention seeks to overcome these and other disadvantages or shortcomings of the prior art by providing a reglet assembly that accommodates longitudinal expansion without leakage at longitudinally-adjacent joints, as well as providing for a snap-on flashing or skirt component that only requires installation forces that are directed toward the wall, thus avoiding adverse effects on sealants, water-proof membranes, or other wall surface panels or structures. In at least one version of the present invention, the reglet assembly also accommodates irregularities along the surface of the wall, such as high or low points or recesses resulting from masonry mortar joints.

These and other objects, advantages, and features of the present invention will become apparent from the following description and the appended claims, taken in conjunction with the accompanying drawings.

BRIEF DESCRIPTION OF THE DRAWINGS

FIG. 3 is a perspective view of the splicer member of FIG. 2.

FIG. 4 is a lateral cross-sectional view similar to that of FIG. 1, but illustrating a variation on the reglet assembly of the present invention.

DETAILED DESCRIPTION OF THE PREFERRED EMBODIMENTS

Figure 1:
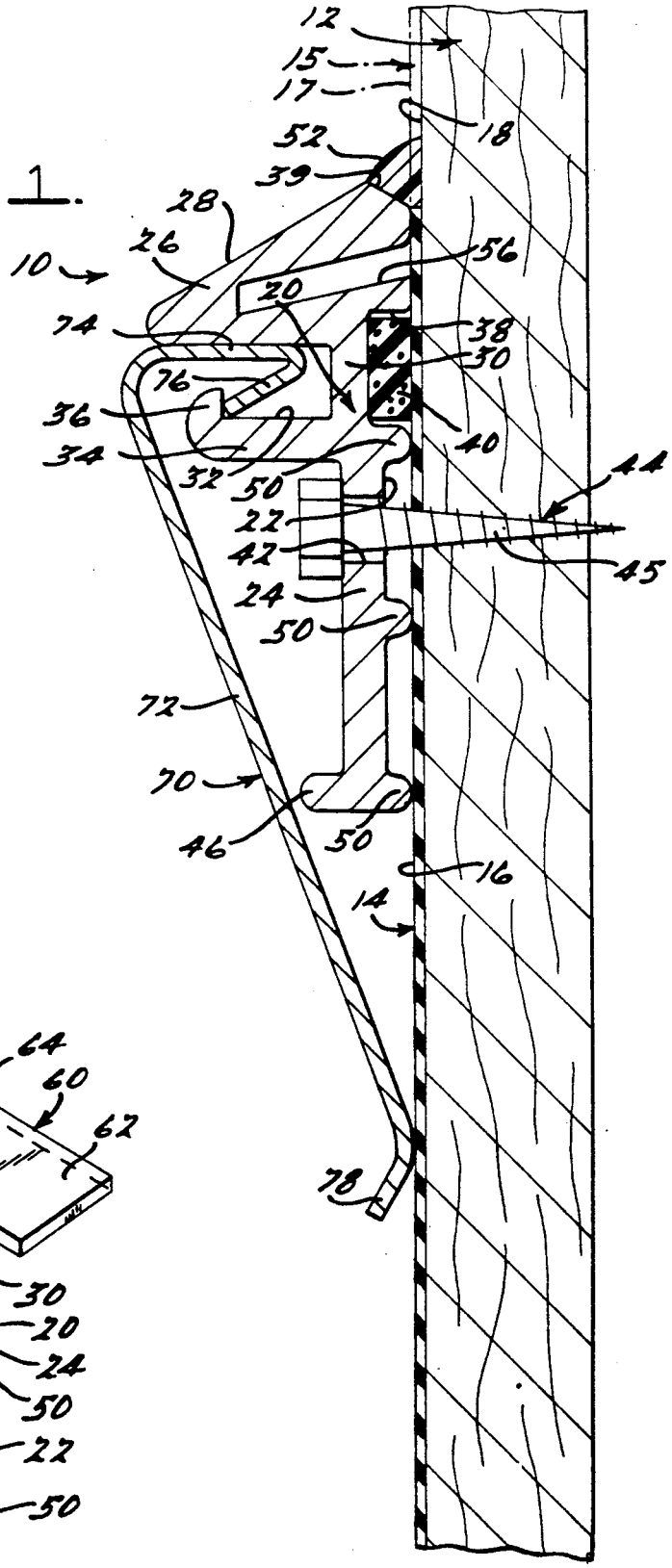
FIG. 1 is a lateral cross-sectional view of an exemplary reglet assembly according to the present invention, shown installed on the vertical surface of a wall structure.

In FIGS. 1 through 4, and in the discussion herein, various embodiments of a reglet assembly according to the present invention are illustrated and described. Although the drawings depict the invention as installed on the vertical surface of a wall structure for covering and sealing the termination edge of a water-proof membrane extending along the wall structure, one skilled in the art will readily appreciate from the following discussion that the invention is equally applicable for installations covering edge terminations or joints between two or more wall panels, surfaces or structures, and that the present invention also provides advantageous application in reglet, flashing, or coping installations other than those shown merely for purposes of exemplary illustration in the drawings.

In FIG. 1, an exemplary reglet assembly 10 is depicted as installed on a wall structure 12 having a relatively thin resilient membrane or panel 14 extending along a portion of the outer surface 18 of the wall structure 12, with the reglet assembly 10 forming a water-tight cover for the termination edge of the membrane 14. As is mentioned above, the reglet assembly 10, as well as the other embodiments shown in the drawings and described herein, are equally applicable for forming a water-tight cover for a joint between two or more adjacent panels or membranes, such as the membrane 14 and an optional relatively thin membrane or panel 15 illustrated in phantom lines in FIG. 1.

The exemplary reglet assembly 10 preferably includes a termination bar member 20, which is secured to the wall structure 12 by way of a fastener 44 having a shank 45 extending through a securement opening 42 in the bar member 20 and threadably engaging the wall structure 12. Although such a threaded fastener is shown for purposes of illustration in the drawings, one skilled in the art will recognize that other fastening or securing devices may alternately be employed, such as rivets, nails, or other such well-known fastening or securing devices.

The preferably extruded bar member 20, with its inner side 22 oriented toward the wall surface 16 of the membrane 14 (and also toward the wall surface 17 of the optional membrane 15), includes a vertical bar portion 24, an upper bar portion 26, with an outer surface 28 of the upper bar portion 26 preferably sloping downwardly and outwardly with respect to the wall structure 12, and an intermediate bar portion 30. The upper bar portion 26 preferably includes an inwardly-opening insert opening 56 (described below), as well as a beveled portion 39 that forms a generally V-shaped groove with the wall surface 18 of the wall structure 12 for receiving a sealing caulk 52 or other suitable sealing member in order to provide a water-tight joint between the upper bar portion 26 and the wall structure 12.

The intermediate bar portion 30 preferably includes an outwardly-opening channel 32, which is preferably formed between the upper bar portion 26 and an outwardly-extending leg 34. A barbed portion 36 is preferably formed generally along the outer edge of the leg 36, and serves to retain a snap-on flashing or skirt member 70, as is described in more detail below. The intermediate bar portion 30 also preferably includes an inwardly-opening channel 38 for receiving an optional sealing member 40, which can be a resilient rubber or elastomeric member, a resilient sponge gasket, or other such known resilient sealing members. Such sealing member 40, when used in conjunction with the exemplary reglet assembly 10, serves to further enhance the water-proof installation of the reglet assembly 10, as well as accommodating surface irregularities along the wall structure 12 by resiliently compressing at high points and resiliently expanding at low points. In addition, when the bar member 20 is secured and the sealing member 40 is expanded, the sealing member 40 also serves as an excellent backing structure for the field-applied sealing caulk 52 along the top edge of the upper bar portion 26.

Figure 2:
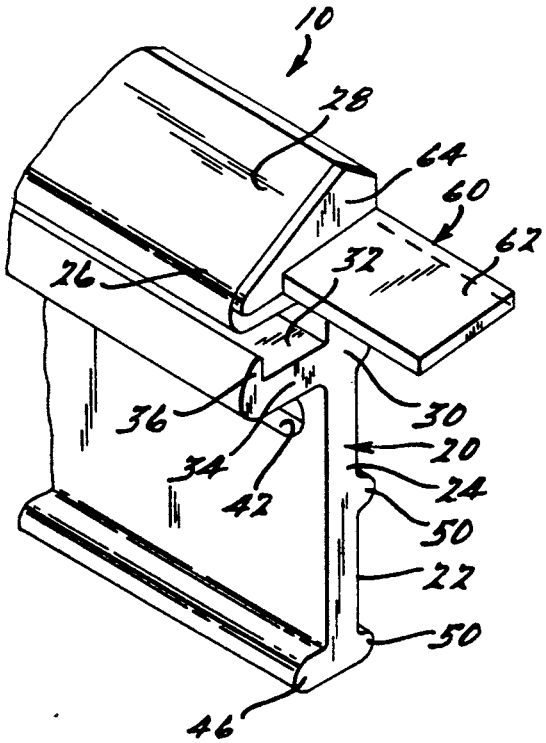
FIG. 2 is a partial perspective detail of the reglet assembly of FIG. 1, illustrating a splicer member according to the present invention for properly aligning and joining longitudinally adjacent sections of the reglet assembly.

In the exemplary reglet assembly 10 illustrated in FIGS. 1 and 2, the vertical bar portion 24 preferably includes one or more longitudinally-extending protuberances 50 protruding inwardly to engage the wall surface 18 of the wall structure 12. Such protuberances 50 compressingly abut the membrane 14 and hold it tightly against the wall structure 12, as well as serving to stiffen the bar member 20. A stiffening rib 46 is also preferably provided generally along the lower edge of the vertical bar portion 24 and protrudes outwardly relative to the wall structure to further stiffen the bar member 20.

The above-mentioned flashing or skirt member 70 generally includes a sloping flashing portion 72, an upper flashing portion 74, and a lower drip edge portion 78. The upper flashing portion 74 preferably includes a hooked portion 76 extending generally downwardly and outwardly relative to the wall structure 12 for interlockingly engaging the barbed portion 36 on the leg 34 of the upper bar portion 26. Because the flashing member 70 is preferably composed of a resilient material, the flashing member 76 can be easily installed on the bar member 20 in a snapped-in relationship when the upper flashing portion 74 is inserted into the outwardly-opening channel 32. Because of such preferred resilient composition, the hooked portion 76 resiliently deflects during the insertion of the upper flashing portion 74 into the channel 32 in order to pass by the barbed portion 36 on the bar member 20, as well as resiliently biasing the upper flashing portion 74 generally upwardly into engagement with the upper bar portion 26 when fully installed in the above-mentioned snapped-in relationship. In addition, such preferred resilient composition of the flashing member 70 also results in the downwardly and outwardly sloping lower drip edge portion 78 being resiliently biased against the wall structure 12, thus providing for a neat, rattle-free and water-tight installation of the flash member 70, as well as providing an inwardly-directed biasing and sealing force on the membrane 14.

In order to further facilitate the ease of installation of the reglet assembly 10, as well as a neat appearing final assembly, the securement openings 42 in the exemplary reglet assembly 10 can optionally be enlarged relative to the diameter of the shank 45 of the fastener 44. Such enlargement can be in the horizontal direction, in the vertical direction, or in both directions, thus allowing horizontal and/or vertical movement of longitudinally-adjacent bar members 20 for a neat, properly aligned end-to-end relationship prior to tightening the fastener 44.

FIGS. 2 and 3 illustrate a preferred splicer member 60 that provides a leak-proof junction between longitudinally-adjacent sections of the bar member 20, as well as assisting in the proper end-to-end alignment of such adjacent sections. The preferred splicer member 60 includes a pair of generally horizontally-extending insert portions 62 and a transversely-extending fin 64. Such insert portions 62 are adapted to be snugly and sealingly inserted into the above-mentioned insert openings 56 in longitudinally-adjacent bar members 20. In order to accomplish this, the splicer member 60 is preferably composed of a plastic, hard rubber, or other elastomeric and resilient material in order to form a snug, water-tight engagement of the insert portions 62 within the insert openings 56. In addition, such a resilient construction of the splicer member 60 allows the fin 64 to resiliently compress or expand in order to accommodate longitudinal expansion or contraction of adjacent bar members 20, while still maintaining a water-tight seal therebetween. In this regard, the fin 64 is preferably formed with a lateral cross-sectional shape that is complementary to at least a portion of the lateral cross-sectional shape of the upper bar portion 26 in order to enhance the sealing relationship between longitudinally-adjacent bar members 20.

Thus, as can now be readily appreciated by one skilled in the art, the exemplary reglet assembly 10, along with its splicer member 60, provides a neat-appearing, water-tight cover for a junction or termination between two or more wall surfaces on the wall structure 12. In addition, by virtue of the configuration and resilient composition of the flashing member 70, installation of the flashing member 70 is accomplished merely by inwardly-directed forces snapping the flashing member 70 into the outwardly-opening channel 32 on the bar member 20, thus avoiding adverse effects on the sealing caulk 52 and the membrane 14.

FIG. 4 illustrates a variation of a preferred reglet assembly 10, in which an exemplary reglet assembly 110 is generally similar to the reglet assembly 10, and thus the various components of the reglet assembly 110 of FIG. 4 are illustrated by reference numerals that are the same as those of the reglet assembly 10, but having one-hundred prefixes.

The basic difference between the reglet assembly 110 and the reglet assembly 10 is in the elimination of the protuberances 50 of the reglet assembly 10, with the vertical bar portion 124 of the bar member 120 having a generally flat inwardly-directed surface 122. Such a configuration may be advantageous in installations where the stiffening effect of the protuberances 50 are deemed to be unnecessary, while still tightly retaining and urging the membrane 14 against the wall surface 18 of the wall structure 12 as a result of the abutting engagement of the generally flat inner side 122 of the vertical bar portion 124 against the membrane 14. In other respects, however, the reglet assembly 110 of FIG. 4 is generally similar in configuration and performance to the reglet assembly 10 depicted in FIGS. 1 and 2.

The foregoing discussion discloses and describes merely exemplary embodiments of the present invention for purposes of illustration only. One skilled in the art will readily recognize from such discussion, and from the accompanying drawings and claims, that various changes and modifications, and variations can be made therein without departing from the spirit and scope of the invention as defined in the following claims.

What is claimed is:

1. A reglet assembly for covering at least a pair of adjacent vertical wall surfaces of a vertical wall structure, said reglet assembly comprising:

a generally horizontally-elongated bar member having an inner side positionable generally against the wall in an overlapping relationship with at least a portion of a first of the pair of vertical wall surfaces, said bar member having a generally vertical bar portion, an upper bar portion with an outer surface of said upper bar portion sloping generally downwardly and outwardly away from the vertical wall, and an intermediate bar portion having an outwardly-opening channel formed therein, said bar member including an insert opening formed therein at least at a location adjacent a longitudinal end of said bar member;

securing means for securing said bar member to the vertical wall;

a generally horizontally-elongated flashing member attachable to said bar member, said flashing member having a sloping flashing portion extending generally downwardly and inwardly generally from a vertical location outwardly adjacent said intermediate bar portion to a vertical location below said bar member, said flashing member also having an upper flashing portion extending generally inwardly from said sloping flashing portion to be receivable in said outwardly-opening channel in said bar member, and a lower flashing portion abuttingly engageable with the vertical wall;

retaining means for retaining said upper flashing portion in said outwardly-facing channel with said lower flashing portion abuttingly engaging the wall; and said reglet assembly further including a splicer member having insert portions thereof insertable into said insert opening in each of a pair of said bar members disposed adjacent one another in a generally end-to-end relationship in order to interconnected and align said ends of said adjacent bar members.

2. A reglet assembly according to claim 1, wherein said flashing member is composed of a resiliently deflectable material, said lower flashing portion being resiliently biased into said abutting engagement with the wall when said upper flashing portion is received and retained in said outwardly-facing channel.

3. A reglet assembly according to claim 1, wherein said retaining means includes a hooked portion on said upper flashing portion and a barbed portion in said outwardly-opening channel in said bar member, said hooked portion and said barbed portion interlockingly engaging one another in a snapped-in relationship when said upper flashing portion is received within said outwardly-opening channel.

4. A reglet assembly according to claim 3, wherein said flashing member is composed of a resiliently deflectable material, said lower flashing portion being resiliently biased into said abutting engagement with the wall when said upper flashing portion is received and retained in said outwardly-facing channel.

5. A reglet assembly according to claim 1, wherein said vertical bar portion has at least one elongated protuberance extending generally horizontally on said inner side, said protuberance abuttingly engaging said first of the wall surfaces when said bar member is secured to the wall.

6. A reglet assembly according to claim 1, wherein said inner side of said vertical bar portion is generally flat, said generally flat inner side of said vertical bar portion abuttingly engaging said first of the wall surfaces when said bar member is secured to the wall.

7. A reglet assembly according to claim 1, further including sealing means for sealingly engaging said upper bar portion and a second of the wall surfaces.

8. A reglet assembly according to claim 1, wherein said bar member further includes a second channel formed in said inner side thereof and opening generally inwardly toward the wall, said reglet assembly further including a sealing member disposed within said second channel for sealingly engaging said inner side of said bar member and at least one of the wall members.

9. A reglet assembly according to claim 1, wherein said splicer member is composed of a resilient material in order to accommodate longitudinal movement of said adjacent bar members.

10. A reglet assembly according to claim 9, wherein said splicer member further includes a fin protruding transversely relative to said insert portions, said fin having a lateral cross-sectional shape complementary to at least a portion of the lateral cross-sectional shape of said upper bar portion and being disposed between said upper bar portions of said adjacent bar members when said insert portions of said splicer member are inserted into said insert openings in said adjacent bar members.

11. A reglet assembly according to claim 1, wherein said securing means includes a number of securement openings extending through said vertical bar portion and arranged serially longitudinally therealong, and a number of fasteners insertable through said securement openings for fastening engagement with the wall.

12. A reglet assembly according to claim 11 wherein said securement openings are longitudinally enlarged in order to allow for longitudinal adjustment of the position of the bar member on the wall.

13. A reglet assembly according to claim 11, wherein said securement openings are vertically enlarged in order to allow for vertical adjustment of the position of the bar members on the wall.

14. A reglet assembly according to claim 1, wherein said flashing member further includes a lower drip edge extending longitudinally therealong generally adjacent said lower flashing portion, said lower drip edge sloping generally downwardly and outwardly away from the wall.

15. A reglet assembly according to claim 1, wherein one of the wall surfaces is on a panel disposed on a portion of the wall in a generally flat engagement therewith.

16. A reglet assembly according to claim 15, wherein said panel is a resilient membrane.

17. A reglet assembly according to claim 1, wherein each of the wall surfaces is on one of a pair of adjacent panels disposed in a generally end-to-end relationship on the wall in a generally flat engagement therewith.

18. A reglet assembly according to claim 1, wherein said outwardly-opening channel formed in said bar member is disposed generally below said upper bar portion, said upper flashing portion including means for resiliently biasing said upper flashing portion into engagement with said upper bar portion when received within said outwardly-opening channel.

19. A reglet assembly for sealingly interconnected at least a pair of adjacent vertical wall surfaces of a vertical wall structure, said reglet assembly comprising:

a generally horizontally-elongated bar member having an inner side positionable generally against the wall in an overlapping relationship with at least a portion of a first of the pair of vertical wall surfaces, said bar member having a generally vertical bar portion, an upper bar portion with an outer surface of said upper bar portion sloping generally downwardly and outwardly away from the vertical wall, and an intermediate bar portion having an outwardly-opening channel formed therein, said outwardly-opening channel having a barbed portion therein, said bar member including an insert opening formed therein at least at a location adjacent a longitudinal end of said bar member;

securing means for securing said bar member to the vertical wall;

a generally horizontally-elongated resilient flashing member having a sloping flashing portion extending generally downwardly and inwardly from a vertical location outwardly adjacent said intermediate bar portion to a vertical location below said bar member, said flashing member also having an upper flashing portion extending generally inwardly to be received in said outwardly-opening channel in said bar member and a resilient hooked portion on said upper flashing portion for resiliently and interlockingly engaging said barbed portion in said outwardly-opening channel in a snapped-in relationship when said upper flashing portion is received within said outwardly-opening channel, said resiliently hooked portion also resiliently biasing said upper flashing portion generally upwardly into engagement with said upper bar portion when said upper flashing portion is received within said outwardly-opening channel, said resilient flashing member further including a lower drip edge portion extending longitudinally therealong and sloping generally downwardly and outwardly away form the vertical wall, said lower drip edge being resiliently biased against the vertical wall when said upper flashing portion is snapped into said outwardly-opening channel in said bar member;

sealing means for sealingly engaging said upper bar portion and the vertical wall; and said reglet assembly further including a splicer member having insert portions thereof insertable into said insert opening in each of a pair of said bar members disposed adjacent one another in a generally end-to-end relationship in order to interconnected and align said ends of said adjacent bar members.

20. A reglet assembly according to claim 19, wherein said vertical bar portion has at least one elongated protuberance extending generally horizontally on said inner side, said protuberance abuttingly engaging said first of the wall surfaces when said bar member is secured to the wall.

21. A reglet assembly according to claim 19, wherein said inner side of said vertical bar portion is generally flat, said generally flat inner side of said vertical bar portion abuttingly engaging said first of the wall surfaces when said bar member is secured to the wall.

22. A reglet assembly according to claim 19, wherein said bar member further includes a second channel formed in said inner side thereof and opening generally inwardly toward the wall, said reglet assembly further including a sealing member disposed within said second channel for sealingly engaging said inner side of said bar member and at least one of the wall members.

23. A reglet assembly according to claim 19, wherein said splicer member is composed of a resilient material in order to accommodate longitudinal movement of said adjacent bar members.

24. A reglet assembly according to claim 23, wherein said splicer member further includes a fin protruding transversely relative to said insert portions, said fin having a lateral cross-sectional shape complementary to at least a portion of the lateral cross-sectional shape of said upper bar portion and being disposed between said upper bar portions of said adjacent bar members when said insert portions of said splicer member are inserted into said insert openings in said adjacent bar members.

25. A reglet assembly according to claim 19, wherein said securing means includes a number of securement openings extending through said vertical bar portion and arranged serially longitudinally therealong, and a number of fasteners insertable through said securement openings for fastening engagement with the wall.

26. A reglet assembly according to claim 25, wherein said securement openings are longitudinally enlarged in order to allow for longitudinal adjustment of the position of the bar member on the wall.

27. A reglet assembly according to claim 25, wherein said securement openings are vertically enlarged in order to allow for vertical adjustment of the position of the bar members on the wall.

28. A reglet assembly according to claim 19, wherein one of the wall surfaces is on a panel disposed on a portion of the wall in a generally flat engagement therewith.

29. A reglet assembly according to claim 28, wherein said panel is a resilient membrane.

30. A reglet assembly according to claim 19, wherein each of the wall surfaces is on one of a pair of adjacent panels disposed in a generally end-to-end relationship on the wall in a generally flat engagement therewith.

* * * * *

UNITED STATES PATENT AND TRADEMARK OFFICE

CERTIFICATE OF CORRECTION

PATENT NO. : 5,123,208

DATED : June 23, 1992

INVENTOR(S) : Kirby, et al

It is certified that error appears in the above-identified patent and that said Letters Patent is hereby corrected as shown below:

On the Title Page under "Other Documents", insert --Wall Connecting Profile - Edge Trim--.

On the Title Page under "Other Documents", insert --pp/product presentation - HICKMAN REGLETS Control Water Where A Roof Meets A Wall; NEW From HICKMAN - SURFACE-MOUNTED Reglet; NEW From HICKMAN ... "HINGE-LOCK" 2-piece Reglet & Flashing System - 1 page--.

Column 5, line 38, Claim 1, Begin new paragraph with "said reglet assembly...".

Column 5, lines 42-43, Claim 1, "interconnected" should be --interconnect--.

Column 7, line 1, Claim 19, "interconnected" should be --interconnecting--.

Column 7, line 35, Claim 19, "resiliently" should be --resilient--.

Column 7, lines 54-55, Claim 19, "interconnected" should be --interconnect--.

Signed and Sealed this

Twenty-eighth Day of December, 1993

*Attest:*

Bruce Lehman

BRUCE LEHMAN

*Attesting Officer*

*Commissioner of Patents and Trademarks*